US006161716A

United States Patent [19]

Oberhofer et al.

[11] Patent Number: 6,161,716

[45] Date of Patent: Dec. 19, 2000

[54] CLOSURE WITH A PRESSURE COMPENSATION VALVE FOR A LIQUID CONTAINER

[76] Inventors: Kurt Oberhofer, Hohenweg 24; Karl Batschied, Erlbrunnenweg 1, both of Wilhelmsfeld; Udo Schreiner, Waldstrasse 22, Neckargemünd, all of Germany

[21] Appl. No.: 09/341,327

[22] PCT Filed: Oct. 30, 1998

[86] PCT No.: PCT/DE98/03179

§ 371 Date: Jul. 2, 1999

§ 102(e) Date: Jul. 2, 1999

[87] PCT Pub. No.: WO99/23009

PCT Pub. Date: May 14, 1999

[30] Foreign Application Priority Data

Nov. 3, 1997 [DE] Germany ..... 197 48 365

[51] Int. Cl.[7] ..... B65D 51/16

[52] U.S. Cl. ..... 220/203.04; 220/367.1; 220/363; 220/745; 217/99; 217/110; 215/364; 215/311

[58] Field of Search ..... 220/203.04, 203.05, 220/203.06, 203.13, 203.19, 367.1, 233, 745, 360, 361, 363, 601, 86.1, 782, 789, 790, 792, 801–804; 215/311, 364, 355, 354, 352, 341, 320, 317, 316; 219/99, 110, 98

[56] References Cited

U.S. PATENT DOCUMENTS

| | | | |
|---|---|---|---|
| 1,747,873 | 2/1930 | Mastrone . | |
| 4,552,283 | 11/1985 | Poldner | 220/304 |
| 4,572,390 | 2/1986 | Grittmann . | |
| 4,595,172 | 6/1986 | Henderson | 220/361 |
| 4,658,979 | 4/1987 | Mietz et al. | 220/367.1 X |
| 4,779,755 | 10/1988 | Harris | 220/203.04 |
| 4,909,276 | 3/1990 | Bayly et al. | 220/203.04 |
| 5,353,472 | 10/1994 | Benda et al. | 217/110 X |
| 5,509,564 | 4/1996 | Knoop | 220/360 |
| 5,697,510 | 12/1997 | Wang et al. | 215/262 |
| 5,799,813 | 9/1998 | Letica | 220/254 |
| 5,868,273 | 2/1999 | Daenen et al. | 215/314 |
| 5,947,326 | 9/1999 | O'Hern et al. | 215/355 X |
| 6,065,631 | 5/2000 | Oberhofer et al. | 220/363 X |

FOREIGN PATENT DOCUMENTS

| | | |
|---|---|---|
| 296830 | 2/1916 | Germany . |
| 4219571 | 12/1993 | Germany . |

*Primary Examiner*—Nathan J. Newhouse
*Attorney, Agent, or Firm*—Galgano & Burke

[57] ABSTRACT

The closure has a bung-type socket (10) of soft elastic material with a flange-like outer bearing portion (12), a circumferential sealing portion (16) sealingly receiving the rim of the hole, and a circumferential snap-action portion (18) engaging the inside of the rim of the hole from behind. In the sealing portion (16) and the snap-action portion (18) of the bung-type socket (10) there is embedded a coaxial reinforcing ring (20) of hard plastic, which is radially rippled over the circumference and thereby is covered by the soft-elastic material in thickness varying over the circumference. The bung-type socket (10) has a central orifice (24), in which a manually adjustable valve element (26) of the pressure-compensating valve occupies a sealing closed position and a pressure-compensating position.

16 Claims, 6 Drawing Sheets

XXI
78
10
12
20
14
62
24
28
18
64
60

74
10

26
26
32
36
76
66
68
80
XXIII 82
68
10

84
82
68
64
10

72
80
26
76
70

CLOSURE WITH A PRESSURE COMPENSATION VALVE FOR A LIQUID CONTAINER

BACKGROUND OF THE INVENTION

The invention relates to a closure with pressure-compensating valve for the filling hole of a liquid container, with a bung-type socket of soft elastic material which fits into the round hole and has a flange-like outer bearing portion, a circumferential sealing portion sealingly receiving the rim of the hole, a circumferential snap-action portion engaging the inside of the rim of the hole from behind, and a central orifice, and with a valve element which can be manually moved into position and. which occupies in the central orifice a sealing closed position and a pressure-compensating position, in which the interior of the container is in communication with the atmosphere.

Such a closure is known from German Patent DE 4219571 C2. It can be used for containers in the form of kegs, mini-kegs (party kegs) or cans, from which liquids, especially beverages, are drawn without pressure or under pressure. It is usable in particular for party kegs for beer.

As set forth in the introduction of German Patent DE 3345619 C2, the snap-action and sealing properties of the bung-type socket of the closure are subject to considerable and in some cases conflicting requirements. To meet these, DE 3345619 C2 proposes making the bung-type socket of a soft part and a hard part, which encloses the soft part in the manner of a cage and through which the soft part penetrates at the apertures between the bars of the cage. The flange-like outside bearing portion of the soft part is stiffened with a flange on the hard part, and outwardly protruding snap catches are provided on the hard part.

A disadvantage of this bung-type socket is its complex structure, which necessitates injection molding of the hard part in a first step, after which the soft part is injection-molded thereonto in a second step. Because of the fact that hard and soft portions alternate over the circumference of the bung-type socket, a leaktightness problem can occur at the edges therebetween. In addition, deposits can accumulate here, with the potential for undesired bacterial growth.

SUMMARY OF THE INVENTION

The object of the invention is to provide a closure of the type cited in the introduction with a bung-type socket which is reinforced with hard plastic, but which has a homogeneous soft surface and such simplified structure that fabrication in the two-plastic injection-molding technique is possible.

This object is achieved with such a closure by the fact that there is embedded in the sealing portion and snap-action portion of the bung-type socket a coaxial reinforcing ring of hard plastic, which is radially rippled over the circumference and thereby is covered by the soft-elastic material in thickness varying over the circumference.

In one preferred embodiment, the snap-action portion and the reinforcing ring have a hook-like profile which is identical everywhere over the circumference.

The bung-type socket of the closure according to the invention is preferably made by the two-plastic injection-molding technique.

In another preferred embodiment, the valve element in closed position and pressure-compensating position snaps onto the bung-type socket.

In the central orifice, the valve element can be moved between closed position and pressure-compensating position by turning and/or by axial displacement. The valve element can be positioned purely by turning and also purely by axial displacement, in which case pressing the valve element into the bung-type socket for pulling it out of the bung-type socket can be used equally well for moving the valve element from closed position to pressure-compensating position and vice versa. Positioning of the valve element by combined turning and axial displacement, especially by quarter-turn adjustment in the manner of a bayonet fastener, is also possible.

In another preferred embodiment the valve element has at least one handle for turning and/or pulling out. Preferably the handle can be laid flat against the upper side of the bung-type socket. When laid flat it can be disposed flush in a recess of the bung-type socket, so that it does not bear load under storage and transportation conditions. In another preferred embodiment the recess has a widened portion, by which the handle can be grasped from underneath while laid flat.

In another preferred embodiment, the closure has an originality-protecting feature, which reveals whether or not the pressure-compensating valve has already been actuated.

In another preferred embodiment, the valve element is provided with a liftable curved handle, which is fastened to the valve element by means of ribs, which break away when the handle is lifted for the first time.

The closure known from German Patent DE 4219571 C2 has a bung-type socket with alternately larger and smaller axial ventilation grooves along the wall of the central orifice and a valve element with alternately larger and smaller axial ventilation fins along the outside surface. The valve element has closed positions, in which matching grooves and fins are in engagement, and pressure-compensating positions, in which non-matching grooves and fins are in engagement.

When the liquid container is completely filled, the bung-type socket dips with its lower end into the liquid. Actuation of the pressure-compensating valve then has the consequence that liquid emerges from the container. A further disadvantage is that it is difficult to distinguish whether the valve element of the pressure-compensating valve is in one of the plurality of possible closed positions or pressure-compensating positions.

The subject matter of another preferred embodiment of the invention is a satisfactorily hygienic, simply and safely operable closure, which is capable of achieving pressure compensation when the container is completely full.

In this embodiment, the bung-type socket has a lateral pressure-compensating duct, the outside end of which is disposed above the liquid level in the completely filled container. The valve element can be turned within limits defined by stops from a clearly defined closed position to a clearly defined pressure-compensating position and back. The valve element in pressure-compensating position opens up a flow path from the inside end of the pressure-compensating duct to the upper side of the bung-type socket, while in closed position it shuts off the path on the inside, covers it on the outside and seals it tightly on both inside and outside.

The clear definition of a closed position and pressure-compensating position and the action of turning the valve element therebetween within limits defined by stops make this closure very safe to operate. The positions can be clearly marked, and it is apparent at any time whether the valve element is in closed position or pressure-compensating position. The outside cover and seal of the pressure-compensating flow path when the valve element is in closed position ensure that no residual liquid or rinse liquid can enter the closure during the filling process. The closure therefore satisfies the most stringent hygiene requirements.

In one preferred embodiment, the valve element has an external flange, which fits into a recess of the bung-type socket. On the bottom of the recess there is provided a groove extending outward from the central orifice. The valve element has a surface groove, which in pressure-compensating position brings the inside end of the pressure-compensating duct into communication with the groove on the bottom of the recess.

In another preferred embodiment, the flange of the valve element is noncircular. In closed position and pressure-compensating position it snaps radially onto the outside of the bung-type socket with a projection. In closed position the projection covers the outside end of the groove on the bottom of the recess.

In another preferred embodiment, the valve element is notched over the circumference. The bung-type socket is provided with a cog, which locates the notch and becomes stopped at the ends thereof, thereby limiting the adjustment angle of the valve element and defining the closed position and pressure-compensating position.

In another preferred embodiment, the portion of the valve element disposed opposite the inside end of the pressure-compensating duct forms in circumferential direction a ramp, which descends in turning direction from closed position to pressure-compensating position. By virtue of this ramp, the initial bias exerted by the seal against the inside end of the pressure-compensating duct is gradually relaxed when the valve element is turned from closed position to pressure-compensating position. This opens up the possibility of smooth, gradual pressure compensation, and in particular careful pressure relief, for example before beer is tapped for the first time.

BRIEF DESCRIPTION OF THE DRAWINGS

The invention will be explained in more detail hereinafter by reference to five practical examples illustrated in the drawing, wherein.

DETAILED DESCRIPTION OF THE PREFERRED EMBODIMENTS

Figure 2:
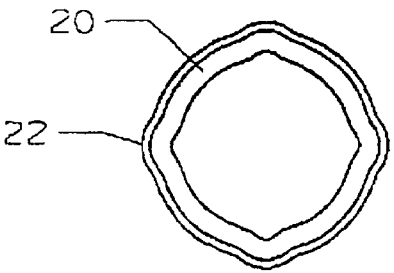
FIG. 2 shows a reinforcing ring of the bung-type socket in axial horizontal projection.
Figure 1:
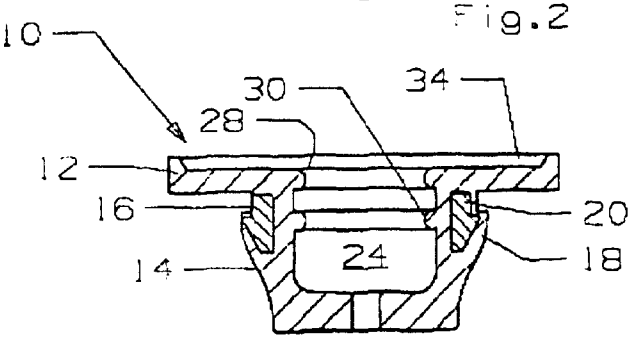
FIG. 1 shows a diametral section through a first bung-type socket.

The closures described hereinafter function to close tightly the filling hole of a liquid container. Examples of such containers are kegs, mini-kegs (party kegs) or cans, from which liquids, especially beverages, can be drawn without pressure or under pressure. It is usable in particular for party kegs for beer.

The filling hole of such containers is a round hole, which is upwardly open during the filling process. The closure contains a bung-type socket 10 of elastic material, which on the outside is substantially rotationally symmetric relative to its central axis and which has an outwardly protruding flange 12, with which it bears against the outside wall of the container. Bung-type socket 10 extends with a substantially conical tapering portion 14 into the container. The generating line of tapering portion 14 is sigmoidally curved. Between flange 12 and tapering portion 14 the diameter of bung-type socket 10 is recessed to form a sealing portion 16 with the shape of an annular groove, into which the rim of the filling hole fits sealingly when bung-type socket 10 is forced into place. The section of larger diameter of bung-type socket 10 forms on the inside in front of sealing portion 16 a circumferential snap-action portion 18 with a hook-like profile which is identical everywhere over the circumference.

In the region of sealing portion 16 and snap-action portion 18, bung-type socket 10 is stiffened by a reinforcing ring 20 of hard plastic completely embedded therein. For reasons of structural simplification, flange 12 of the bung-type socket is not stiffened.

Reinforcing ring 20 has a hook-like profile which is identical everywhere over the circumference. It is disposed coaxially with bung-type socket 10 and is rippled radially over the circumference. Thereby reinforcing ring 20 has four radial swellings 22 disposed at 90° intervals, at which swellings the covering of soft plastic material on bung-type socket 10 is thinner than therebetween.

To dispense liquid, the container has a lower dispensing orifice separate from the filling hole. This can be a bunghole, which is tapped with a tapping fitting or similar device, or a spigot integrated into the container.

Vibrations during transportation and/or warming can cause in beer kegs build-up of considerable overpressure, with the result that almost exclusively foam is tapped at first. It is recommended that this overpressure be carefully relieved before tapping for the first time. For this purpose bung-type socket 10 is equipped with a manually operated pressure-compensating valve.

When liquid is dispensed from the lower dispensing orifice without pressure, a partial vacuum is produced above the liquid level in the container. To break this partial vacuum, air can be admitted to the container via the pressure-compensating valve.

Bung-type socket 10 has a central orifice 24, in which valve element 26 of the pressure-compensating valve is seated. Valve element 26 is accessible from the outside to allow valve operation. In central orifice 24 of bung-type socket 10 it optionally occupies a sealing closed position or a pressure-compensating position, in which the interior of the container above the liquid level therein is in communication with the atmosphere.

In the variant shown in FIG. 1 to FIG. 6, bung-type socket 10 has a through-going axial central orifice 24, the diameter of which is stepped, becoming narrower from outside to inside. On the surface of the orifice portion of larger diameter there are disposed two inwardly protruding annular beads 28, 30 at an axial distance from each other.

Valve element 26 has on its outside a flange 32, which fits into a recess 34 on the outside of the flange of bung-type socket 10. Adjoining the inside of flange 32 there is disposed a plain cylindrical sealing portion 36 of smaller diameter and thereon a circumferential shoulder 38 which projects radially outward. Still further toward the interior, valve element 26 forms a square cross, arms 40 of which are provided with notches 42 at the same axial height. At its interior end, valve element 26 has a rotationally symmetric sealing head 44.

On the outside of the flange of valve element 26 there are attached two oppositely disposed curved handles 46, each extending over almost half the circumference of valve element 26. In storage and transportation position, curved handles 46 rest flat in recess 34 of bung-type socket 10. To operate the pressure-compensating valve, they are pivoted upward in order to pull valve element 26 a short distance out of bung-type socket 10.

Figure 5:
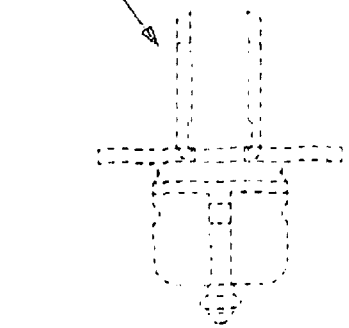
FIG. 5 shows a diametral section through the first bung-type socket with valve element in closed position indicated by broken lines, the valve element also being shown separately in side view of the removed condition with curved handles pivoted upward.
Figure 5:
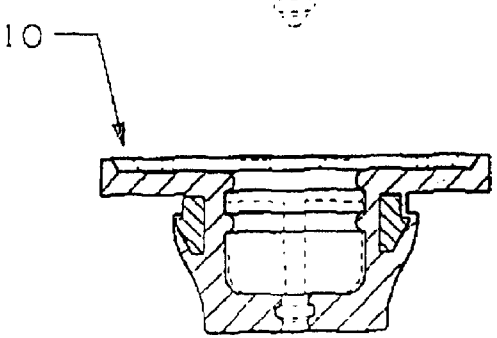
Figure 3:
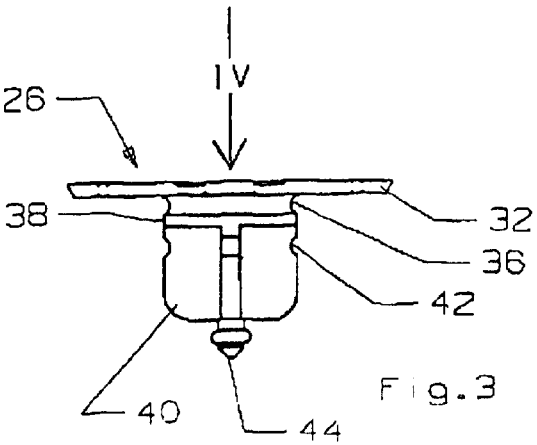
FIG. 3 shows in side view a valve element seated in the bung-type socket.
Figure 4:
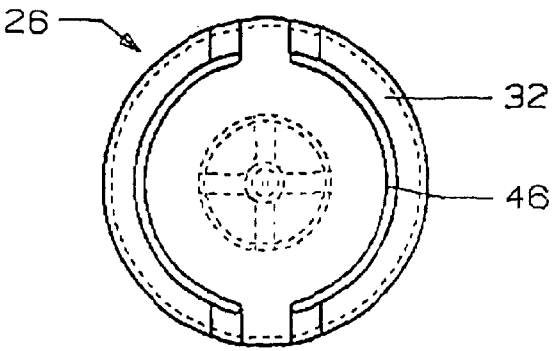
FIG. 4 shows an axial horizontal projection of the valve element seen in direction IV of FIG. 3.
Figure 8:
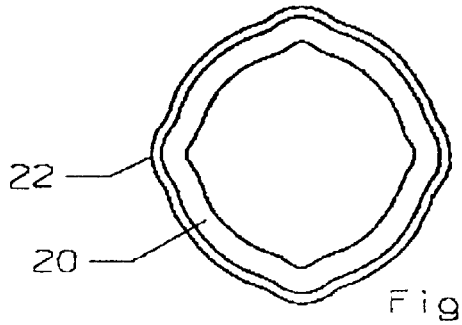
FIG. 8 shows a reinforcing ring of the bung-type socket in axial horizontal projection.
Figure 11:
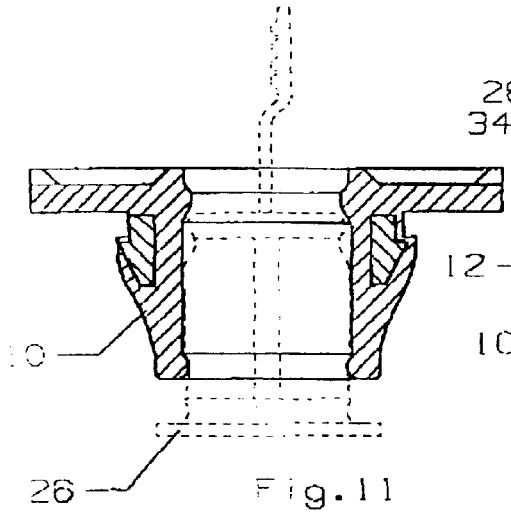
FIG. 11 shows a diametral section through the second bung-type socket with valve element in pressure-compensating position indicated by broken lines.
Figure 7:
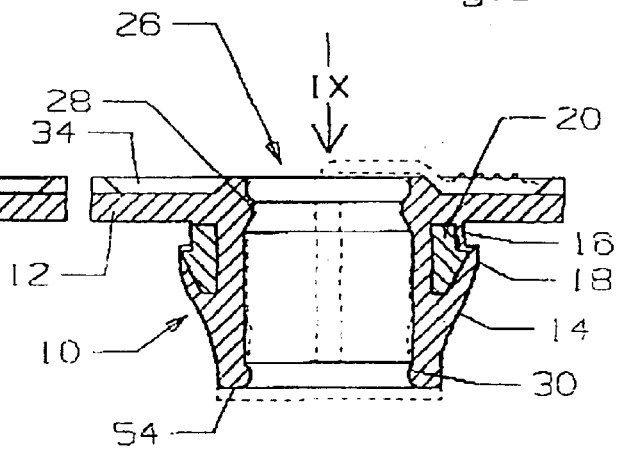
FIG. 7 shows a diametral section through a second bung-type socket with valve element in closed position indicated by broken lines.
Figure 10:
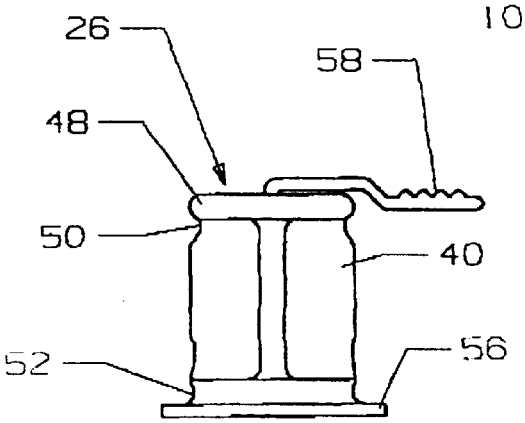
FIG. 10 shows as a detail the valve element in side view.
Figure 9:
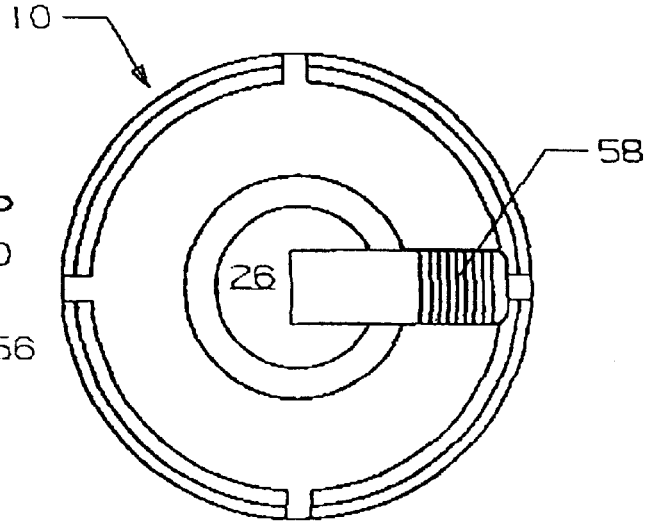
FIG. 9 shows an axial horizontal projection of the bung-type socket seen in direction IX of FIG. 7.
Figure 13:
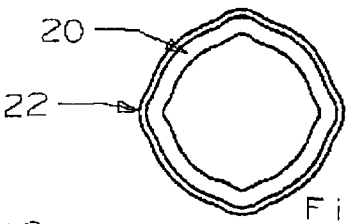
FIG. 13 shows a reinforcing ring of the bung-type socket in axial horizontal projection.
Figure 12:
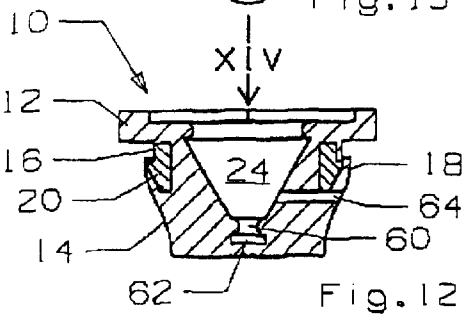
FIG. 12 shows a diametral section through a third bung-type socket.
Figure 14:
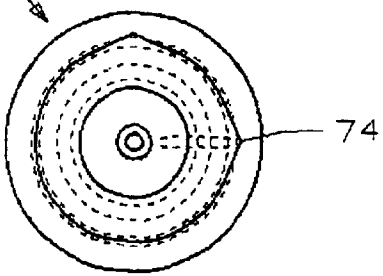
FIG. 14 shows an axial horizontal projection of the bung-type socket seen in direction XIV of FIG. 12.
Figure 17:
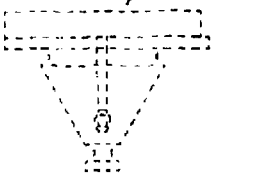
FIG. 17 shows a diametral section through the third bung-type socket with valve element in closed position indicated by broken lines, the valve element also being shown separately in removed condition.
Figure 17:
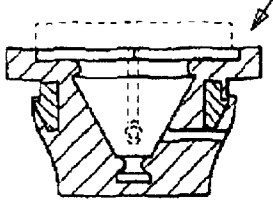
Figure 18:
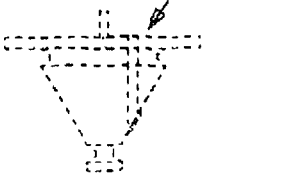
FIG. 18 shows a diametral section through the third bung-type socket with valve element in pressure-compensating position indicated by broken lines, the valve element again also being shown separately in removed condition, turned by 90° relative to FIG. 17.
Figure 18:
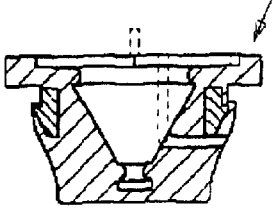
Figure 15:
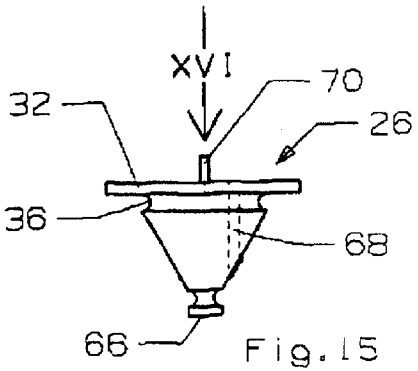
FIG. 15 shows the side view of a valve element belonging to the third bung-type socket.
Figure 16:
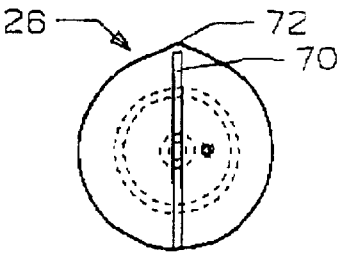
FIG. 16 shows a horizontal projection thereof seen in direction XVI of FIG. 15.
Figures 19, 20, 21, 22, 23, 24, 25:
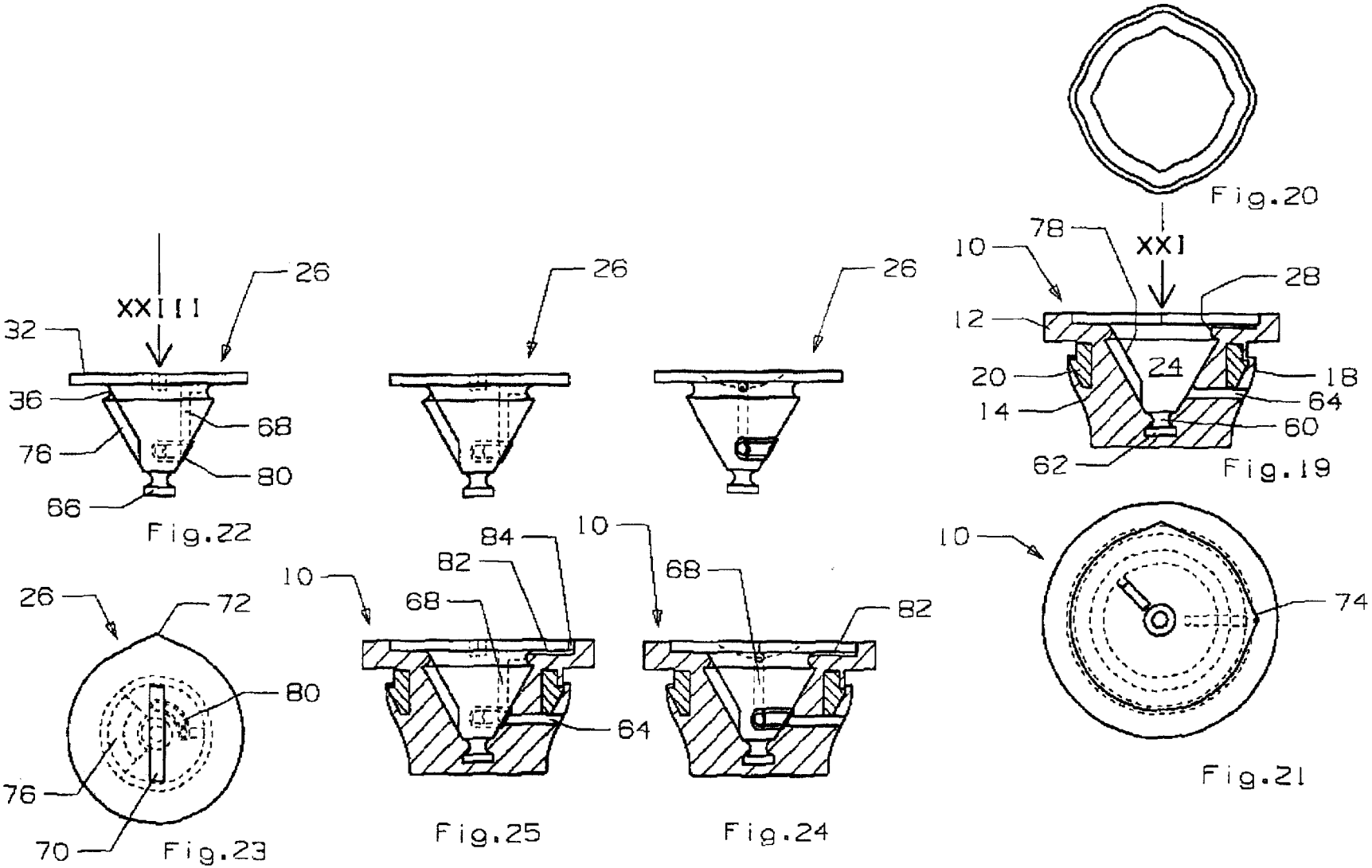
FIG. 19 shows a diametral section through a fourth bung-type socket.
FIG. 20 shows a reinforcing ring of the bung-type socket in axial horizontal projection.
FIG. 21 shows an axial horizontal projection of the fourth bung-type socket seen in direction XXI of FIG. 19.
FIG. 22 shows the side view of a valve element belonging to the fourth bung-type socket.
FIG. 23 shows a horizontal projection thereof seen in direction XXIII of FIG. 22.
FIG. 24 shows a diametral section through the fourth bung-type socket with valve element in closed position indicated by broken lines, the valve element also being shown separately in removed condition.
FIG. 25 shows a diametral section through the third bung-type socket with valve element in pressure-compensating position indicated by broken lines, the valve element again also being shown separately in removed condition, turned by 90° relative to FIG. 24.
Figure 28:
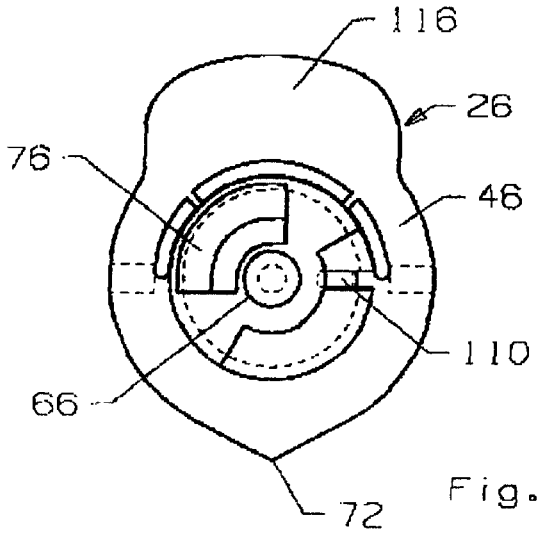
FIG. 28 shows a horizontal projection from below of the valve element seen in direction XXVIII of FIG. 26.
Figure 26:
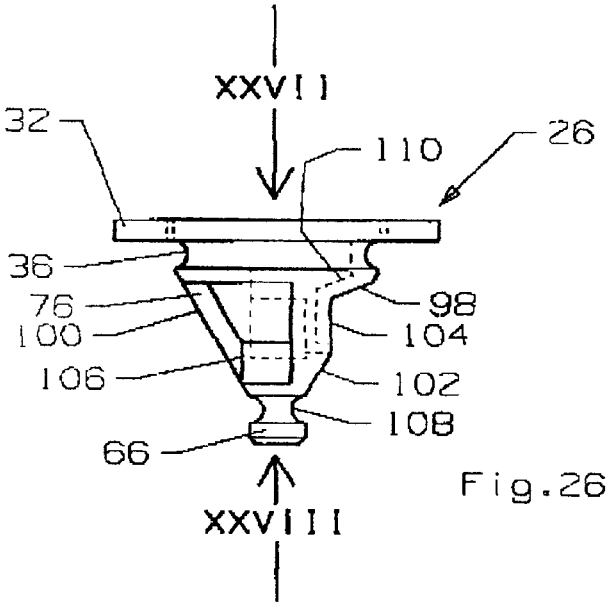
FIG. 26 shows the side view of the valve element of a fifth closure with pressure-compensating valve.
Figure 27:
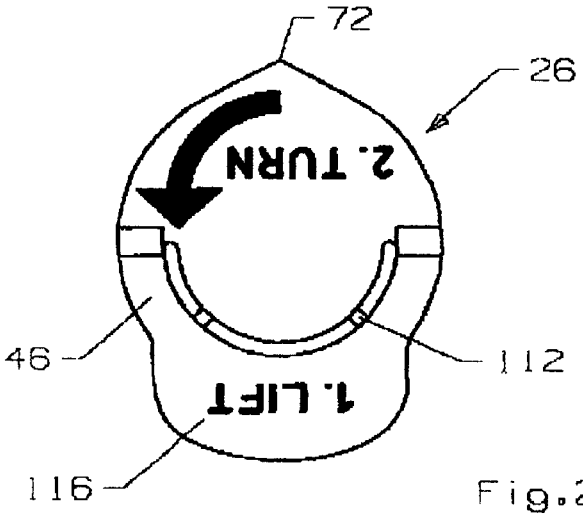
FIG. 27 shows a horizontal projection from above of the valve element seen in direction XXVII of FIG. 26.
Figure 30:
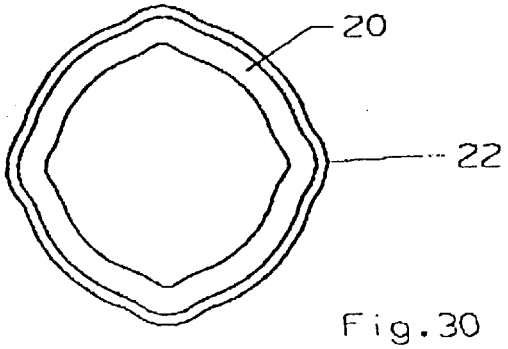
FIG. 30 shows a reinforcing ring of the bung-type socket in axial horizontal projection.
Figure 29:
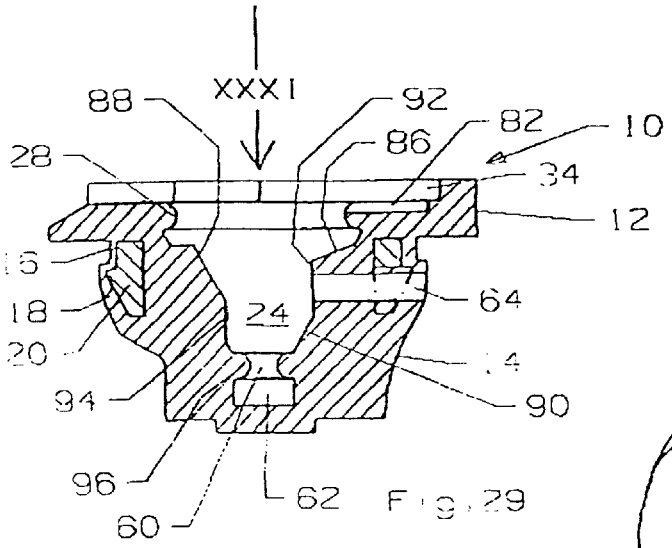
FIG. 29 shows the diametral cross-sectional view through a bung-type socket belonging to the closure.
Figure 32:
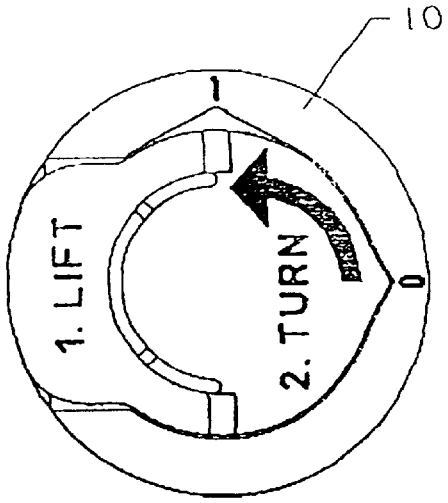
FIG. 32 shows in horizontal projection from above an assembly drawing of bung-type socket and valve element.
Figure 31:
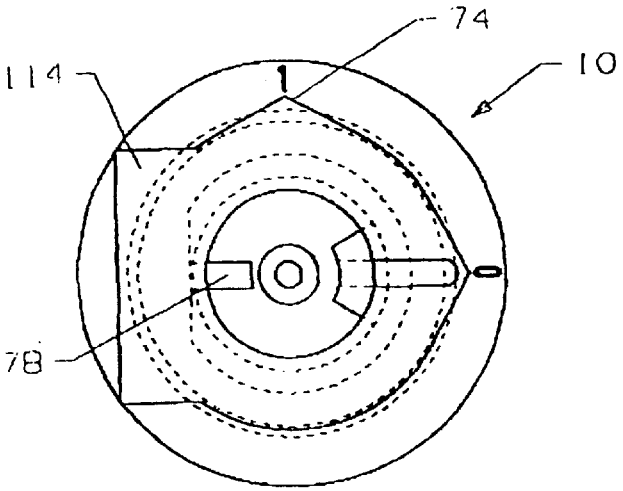
FIG. 31 shows a horizontal projection from above of the bung-type socket seen in direction XXXI of FIG. 29.

As shown in FIG. 5, valve element 26 has in central orifice 24 of bung-type socket 10 a sealing closed position, in which sealing head 44 occupies the interior portion of smaller diameter of central orifice 24. Shoulder 38 of valve element 26 is brought into position between annular beads 28, 30 of bung-type socket 10. Outer annular bead 28 cooperates with sealing portion 36 of valve element 26 to form a dust barrier.

Figure 6:
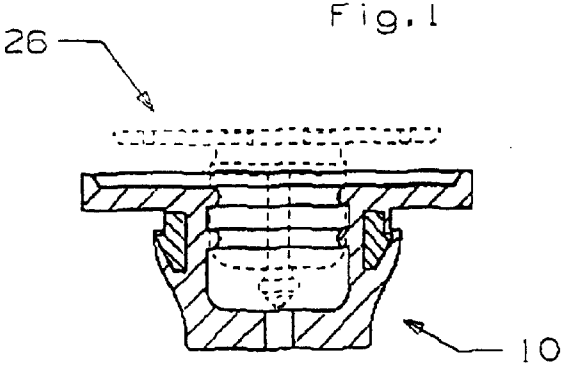
FIG. 6 shows a diametral section through the first bung-type socket with valve element in pressure-compensating position indicated by broken lines.

As shown in FIG. 6, valve element 26 can be pulled sufficiently far out of bung-type socket 10 that sealing head 44 emerges from the portion of smaller diameter of central orifice 24 and inner annular bead 30 snaps into notches 42 of valve element 26. Sealing portion 36 of valve element 26 becomes clear of outer annular bead 28, so that here there is released an annular gap and a flow path into the interior of the container between arms 40 of the cross of the valve element.

In the variant shown in FIG. 7 to FIG. 11, through-going central orifice 24 of bung-type socket 10 has substantially plain cylindrical shape and is provided with annular beads 28, 30 at its outside and inside ends respectively.

Valve element 26 has on the outside a round plate 48, the diameter of which corresponds to the inside width of central orifice 24. At the inside of plate 48 there adjoins a first plain cylindrical sealing portion 50 of smaller diameter, in which outer annular bead 28 engages. Further toward the interior, valve element 26 forms a square cross. At the interior end, valve element 26 has a second plain cylindrical sealing portion 52 of smaller diameter for inner annular bead 30 and a flange 56 bearing on interior end face 54 of bung-type socket 10.

Valve element 26 is forced into bung-type socket 10 in order to move it from closed position to pressure-compensating position. In the latter position, inner annular bead 30 snaps into notches on arms 40 of the cross of the valve element.

To allow it to be pulled out again, valve element 26 has a central gripping strap 58 attached to outside plate 48, which strap extends sideways over flange 12 of burg-type socket 10 and in storage and transportation position rests flat in a recess 34 thereof. When valve element 26 is forced into bung-type socket 10, gripping strap 58 is automatically moved to upright position.

In the variant shown in FIGS. 12 to 18, bung-type socket 10 has a central orifice 24 in the form of a conical blind hole, which tapers toward the interior and ends in a plain cylindrical throat 60 and a substantially plain cylindrical section 62 of larger diameter. Flange 12 of bung-type socket 10 has on the outside a plain cylindrical recess 34 and therebehind, toward the interior, an annular bead 28, which protrudes inward beyond the conical surface of central orifice 24. At the conical surface there extends a radial bore 64, which passes transversely through bung-type socket 10.

Valve element 26 is substantially conical. It has on the interior end an anchoring head 66, which fits into throat 60 and section 62 of larger diameter of central orifice 24. On the outside, valve element 26 has a flange 32 which fits into recess 34 of bung-type socket 10. To this there is adjoined on the inside a circumferential sealing portion 36 of smaller diameter, into which annular bead 28 of bung-type socket 10 snaps.

Valve element 26 has an off-centered axial bore 68, which extends to the conical surface of bung-type socket 10, where it communicates with the end of radial bore 64 in a particular angular position of valve element 26. For pressure compensation, valve element 26 is turned to this angular position by means of a diametral gripping ridge 70 attached to the outside of flange 32, and is restored to sealing closed position by being turned back or further.

Flange 32 of valve element 26 is noncircular. It has a radially projecting nose 72, which fits into bulges 74 of recess 34 of the bung-type socket. Thereby the sealing closed position and the pressure-compensating position of valve element 26 are marked and fixed by snap-in effect. The positions are disposed at 90° intervals.

The variant shown in FIG. 20 to FIG. 25 is modified as follows compared with that just described:

Valve element 26 has on the outside surface a circumferential recess 76 extending over 900. Bung-type socket 10 has on the inside surface a ridge 78, which projects into circumferential recess 76 and acts as a stop to limit the angle through which valve element 26 can be turned.

In front of the end of radial bore 64, valve element 26 has a sealing bead 80 with a circumferential extent of close to 90°. Sealing bead 80 shuts off the end of radial bore 64 and uncovers it only in pressure-compensating position.

Off-centered axial bore 68 of valve element 26 extends only to just under flange 32 thereof, where it communicates with a radial branch duct 82 on the upper side of bung-type socket 10. Branch duct 82 is covered by flange 32, and in pressure-compensating position of valve element 26 is brought into communication with a small axial orifice 84 at the rim of flange 32.

In the variant shown in FIG. 26 to FIG. 32, central orifice 24 of bung-type socket 10 is an inwardly tapering blind hole of basically conical shape, which is not completely axially symmetric but has both conical surface portions 86, 88, 90 and plain cylindrical surface portions 92, 94 distributed over circumference and depth. Valve element 26, which is of substantially complementary geometry, thereby has a well-defined mounting position in central orifice 24.

Flange 12 of bung-type socket 10 has on the outside a substantially plain cylindrical recess 34 of large diameter and therebehind, toward the interior of the central orifice, an annular bead 28, which protrudes radially inward beyond conical surface 86 of central orifice 24. The blind hole ends at the inside in a throat 60 defined by toroidal bead 96 and a plain cylindrical section 62 of larger diameter.

At surface 92 of the blind hole there extends a pressure-compensating duct in the form of a radial bore 64, which passes transversely through bung-type socket 10 at approximately half height. Once bung-type socket 10 has been forced into place, radial bore 64 is disposed above the liquid level in the completely filled container.

Valve element 26 has on the outside a flange 32 which fits into recess 34 of bung-type socket 10. To this there is adjoined on the inside a sealing portion 36 of smaller diameter, into which outer annular bead 28 of bung-type socket 10 snaps. Valve element 26 tapers inwardly with conical surface portions 98, 100, 102 and plain cylindrical surface portions 104, 106 to a neck 108, and ends in a plain cylindrical head 66 of larger diameter. Inner annular bead 30 of bung-type socket 10 snaps into place against neck 108.

Valve element 26 has on the outside surface a notch 76 extending for 90° in circumferential direction. Bung-type socket 10 has on the inside surface a cog 78, which projects into notch 76 and acts as a stop limiting the angle through which valve element 26 can be turned.

The portion of valve element 26 disposed opposite the inside end of pressure-compensating duct 64 forms in circumferential direction a ramp, which descends in the turning direction from closed position to pressure—compensating position.

Valve element 26 has an axial surface groove 110, which extends from the height of the inside end of pressure-compensating duct 64 to the underside of flange 32.

On the bottom of recess 34 of the bung-type socket there is provided a groove 82, which is disposed in the same diametral plane 64 as the pressure-compensating duct and which extends from central orifice 24 of bung-type socket 10 to the outside rim of recess 34.

Flange 32 of valve element 26 is noncircular. It has a radially projecting nose 72, which fits into two bulges 74 of recess 34 of the bung-type socket. Thereby the sealing closed position and the pressure-compensating position of valve element 26 are marked and fixed by snap-in effect. Groove 82 on the bottom of recess 34 of the bung-type socket ends in bulge 74 corresponding to pressure-compensating position.

In pressure-compensating position, a flow path between the interior of the container and the atmosphere is opened up via pressure-compensating duct 64, surface groove 110 and groove 82 on the bottom of recess 34. In closed position, the outside end of groove 82 is covered and tightly closed by nose 72 on flange 32 of valve element 26.

From flange 32 of valve element 26, and extending over half the circumference thereof, there is branched off a curved handle 46, which can be lifted by pivoting around a diametral axis. Curved handle 46 is fastened to valve element 26 with ribs 112, which break off when the handle is lifted for the first time and form clearly visible fracture faces. Thereby originality protection is achieved.

Curved handle 46 is flush-mounted in bung-type socket 10. Recess 34 has a widened portion 114, which extends to the rim of bung-type socket 10 and in which there is disposed a prolongation 116 of curved handle 46, which prolongation projects outwardly from flange 32 and can be grasped from underneath at the rim.

While curved handle 46 is lifted, valve element 26 can be turned from closed position to pressure-compensating position and back.

What is claimed is:

1. A closure with pressure-compensating valve for a filling hole of a liquid container, with a bung-type socket of soft elastic material which fits into the filling hole and has a flange-type outer bearing portion, a circumferential sealing portion sealingly receiving the rim of the hole, a circumferential snap-action portion engaging the inside of the rim of the hole from behind, and a central orifice, and with a valve element which can be manually moved into position and which occupies in the central orifice a sealing closed position and a pressure-compensating position, in which the interior of the container is in communication with the atmosphere, characterized in that there is embedded in the sealing portion (16) and the snap-action portion (18) of the bung-type socket (10) a coaxial reinforcing ring (20) of hard plastic, which is radially rippled over the circumference and thereby is covered by the soft-elastic material in thickness varying over the circumference.

2. A closure according to claim 1, characterized in that the snap-action portion (18) and the reinforcing ring (20) have a hook-shaped profile which is identical everywhere over the circumference.

3. A closure according to claim 1, characterized in that the bung-type socket (10) is made in two-plastic injection-molding technique.

4. A closure according to claim 1, characterized in that the valve element (26) in closed position and pressure-compensating position snaps onto the bung-type socket (10).

5. A closure according to claim 1, characterized in that, in the central orifice (24), the valve element (26) can be moved between closed position and pressure-compensating position by turning and/or by axial displacement.

6. A closure according to claim 1, characterized in that the valve element (26) has at least one handle (46, 58, 70) for turning and/or pulling out.

7. A closure according to claim 6, characterized in that the handle (46, 58) can be laid flat against the outside of the bung-type socket (10).

8. A closure according to claim 7, characterized in that the handle (46, 58) when laid flat rests flush in a recess (34) of the bung-type socket (10).

9. A closure according to claim 8, characterized in that the recess (34) has a widened portion (74), which allows the handle (46) while laid flat to be grasped from underneath.

10. A closure according to claim 1, characterized in that it has an originality-protecting feature, which reveals whether or not the pressure-compensating valve has already been actuated.

11. A closure according to claim 10, characterized in that the valve element (26) is provided with a liftable curved handle (46), which is fastened to the valve element (26) by means of ribs (112), which break away when the handle is lifted for the first time.

12. A closure according to claim 1, characterized in that the bung-type socket (10) has a lateral pressure-compensating duct (64), the outside end of which is disposed above the liquid level in the completely filled container, in that the valve element (26) can be turned within limits defined by stops from a clearly defined closed position to a clearly defined pressure-compensating position and back, and in that the valve element (26) in pressure-compensating position opens up a flow path from the inside end of the pressure-compensating duct (64) to the upper side of the bung-type socket (10), while in closed position it shuts off the path on the inside, covers it on the outside and seals it tightly on both inside and outside.

13. A closure according to claim 12, characterized in that the valve element (26) has an external flange (32), which fits into a recess (34) of the bung-type socket (10), in that on the bottom of the recess (34) there is provided a groove (82) extending outward from the central orifice (24), and in that the valve element (26) has a surface groove (110), which in pressure-compensating position brings the inside end of the pressure-compensating duct (64) into communication with the groove (82) on the bottom of the recess (34).

14. A closure according to claim 13, characterized in that the flange (32) is noncircular and in closed position and pressure-compensating position it snaps radially onto the outside of the bung-type socket (10) with a projection (72), and in that in closed position the projection (72) covers the outside end of the groove (82) on the bottom of the recess (34).

15. A closure according to claim 12, characterized in that the valve element (26) is notched over the circumference, and in that the bung-type socket (10) is provided with a cog (78), which locates the notch (76) and becomes stopped at the ends thereof, thereby limiting the adjustment angle of the valve element (26) and defining the closed position and pressure-compensating position.

16. A closure according to claim 12, characterized in that the portion of the valve element (26) disposed opposite the inside end of the pressure-compensating duct (64) forms in circumferential direction a ramp, which descends in turning direction from closed position to pressure-compensating position.

* * * * *